US008444508B2

(12) United States Patent
Rajagopalan et al.

(10) Patent No.: US 8,444,508 B2
(45) Date of Patent: May 21, 2013

(54) GOLF BALLS COMPRISING HIGHLY- AND PARTIALLY-NEUTRALIZED ALTERNATE COPOLYMERS

(75) Inventors: Murali Rajagopalan, South Dartmouth, MA (US); Michael J. Sullivan, Barrington, RI (US)

(73) Assignee: Acushnet Company, Fairhaven, MA (US)

( * ) Notice: Subject to any disclaimer, the term of this patent is extended or adjusted under 35 U.S.C. 154(b) by 456 days.

(21) Appl. No.: 12/945,069

(22) Filed: Nov. 12, 2010

(65) Prior Publication Data

US 2012/0122612 A1 May 17, 2012

(51) Int. Cl.
*A63B 37/12* (2006.01)

(52) U.S. Cl.
USPC ..... 473/378; 473/374; 473/377

(58) Field of Classification Search
None
See application file for complete search history.

(56) References Cited

U.S. PATENT DOCUMENTS

| | | | | |
|---|---|---|---|---|
| 3,264,272 | A | 8/1966 | Rees | |
| 4,351,931 | A | 9/1982 | Armitage | |
| 5,334,673 | A | 8/1994 | Wu | |
| 5,346,963 | A * | 9/1994 | Hughes et al. | 525/285 |
| 5,484,870 | A | 1/1996 | Wu | |
| 6,756,436 | B2 | 6/2004 | Rajagopalan et al. | |
| 6,939,907 | B2 | 9/2005 | Rajagopalan et al. | |
| 6,953,820 | B2 | 10/2005 | Statz et al. | |
| 6,958,679 | B1 | 10/2005 | Nguyen | |
| 7,037,967 | B2 | 5/2006 | Chen | |
| 7,041,721 | B2 | 5/2006 | Rajagopalan et al. | |
| 7,399,239 | B2 | 7/2008 | Rajagopalan et al. | |
| 7,479,531 | B2 | 1/2009 | Baugh et al. | |
| 7,654,915 | B2 | 2/2010 | Rajagopalan et al. | |
| 2002/0013413 | A1 | 1/2002 | Bellinger et al. | |
| 2002/0155904 | A1 * | 10/2002 | Boehm et al. | 473/371 |
| 2003/0050373 | A1 | 3/2003 | Chen | |
| 2003/0114565 | A1 | 6/2003 | Chen et al. | |
| 2005/0239964 | A1 * | 10/2005 | Chou | 525/178 |
| 2007/0232414 | A1 * | 10/2007 | Rajagopalan et al. | 473/374 |

* cited by examiner

*Primary Examiner* — Gene Kim
*Assistant Examiner* — John E Simms, Jr.
(74) *Attorney, Agent, or Firm* — William B. Lacy

(57) ABSTRACT

A golf ball includes a core having a diameter, a first Shore D hardness and a compression; and a cover having a second Shore D hardness that is at least 5 points less than the first Shore D hardness. The cover includes an ionomer of an alternate copolymer, the alternate copolymer being formed from the reaction product of a copolymer of ethylene and maleic anhydride monomer in the presence of a suitable base, the maleic anhydride monomer being present in an amount of about 78 wt %.

11 Claims, No Drawings

GOLF BALLS COMPRISING HIGHLY- AND PARTIALLY-NEUTRALIZED ALTERNATE COPOLYMERS

FIELD OF THE INVENTION

The present invention is directed to a golf ball and, more particularly, a golf ball cover containing an ionomer of an alternate copolymer.

BACKGROUND OF THE INVENTION

Conventional golf balls can be divided into two general classes: solid and wound. Solid golf balls include one-piece, two-piece (i.e., solid core and a cover), and multi-layer (i.e., solid core of one or more layers and/or a cover of one or more layers) golf balls. Wound golf balls typically include a solid, hollow, or fluid-filled center, surrounded by a tensioned elastomeric material, and a cover. It is also possible to surround a hollow or fluid-filled center with a plurality of solid layers. Solid balls have traditionally been considered longer and more durable than wound balls, but many solid constructions lack the "feel" provided by the wound construction.

More recently, by altering ball construction and composition, manufacturers have been able to vary a wide range of playing characteristics, such as compression, velocity, "feel," and spin, optimizing each or all be optimized for various playing abilities. In particular, a variety of core and cover layer(s) constructions, such as multi-layer balls having dual cover layers and/or dual core layers, have been investigated and now allow many non-wound balls to exhibit characteristics previously maintainable in a solid-construction golf ball. These golf ball layers are typically constructed with a number of polymeric compositions and blends, including polybutadiene rubber, polyurethanes, polyamides, and ethylene-based ionomers.

Ionomers, and in particular ethylene α,β-ethylenically unsaturated carboxylic acid copolymers or a melt processable ionomer thereof, are a preferred polymer for many golf ball layers. One problem encountered with the use of ionomers as stiff layers, however, is the unprocessability of the material as the percent of neutralization of the acid group increases. Ionomers are stiffened by increasing the amount of neutralization by a metal cation or a salt thereof. Once the percent of neutralization is greater than about 60% (depending on metal cation selected), the melt flow of the ionomer becomes too low and the ease of processability decreases or disappears altogether. For tri-valent cations, the percent neutralization at which the polymer becomes unprocessable can be significantly lower.

Conventional maleic anhydride polymers, such as the FUSABOND® series, to date have a very low level of maleic anhydride (i.e., less than 1 wt % for the ethylene based polymers and less than 2 to 3 wt % for propylene based polymers). Higher levels of maleic anhydride are difficult or near impossible to achieve in the post polymerization reactive extrusion process due to excessive degradation of the base polymer and/or availability of sufficient active grafting sites. Hence, only a small amount of ionic cross-linking can be accomplished using the low levels of maleic anhydride grafted polymers in comparison to commercially-available ionomers, such as ethylene-methacrylic acid or acrylic acid copolymers, which typically have an acid content in the range of 5 to 20 wt %. Also, achieving levels higher than 20 wt % of the acid monomer in the acid copolymer is difficult due to problems encountered in the copolymerization process fouling of materials, etc.). These limitations affect the ionic cross-linking level and, therefore, the performance of the golf ball components (i.e., COR, abrasion resistance, etc.).

The present invention addresses these deficiencies by neutralizing an alternate copolymer of ethylene-maleic anhydride or their maleic acid moieties having a very high level of maleic anhydride, typically in the range of up to 78 wt %, preferably about 78 wt %. A suitable flow modifier based on an organic acid or their salts, such as fatty acids/salts, or even polymeric flow modifiers, such as thermoplastic elastomers, can be used during the neutralization process in order to accomplish sufficient melt flow characteristics suitable for golf ball manufacturing processes.

SUMMARY OF THE INVENTION

The present invention is directed to a golf ball including a core having a diameter, a first Shore D hardness and a compression; and a cover having a second Shore D hardness that is at least 5 points greater than the first Shore D hardness, preferably 10 points greater. The cover includes an ionomer of an alternate copolymer, the alternate copolymer formed from the reaction product of a copolymer of ethylene and maleic anhydride monomer in the presence of a suitable base, the maleic anhydride monomer being present in an amount of up to 78%, preferably about 78 wt %. The ionomer of an alternate copolymer may further include a flow modifier, such as a fatty-acid salt or non-fatty-acid salt. The fatty acid, or salt thereof, can be present in an amount of about 10 wt % to about 50 wt %.

The golf ball further may optionally include an intermediate layer having a melt flow of about 0 g/10 min at 190° C. to about 5.0 g/10 min at 190° C., more preferably about 0 g/10 min at 190° C. The optional intermediate layer may be formed from a highly- or fully-neutralized polymer, an ionomer of an alternate copolymer, or a mixture thereof. In one embodiment, the core comprises the ionomer of an alternate copolymer.

The ionomer of an alternate copolymer may be blended with a conventional acid copolymer or the ionomeric derivatives thereof. The core or cover may include ionomeric copolymers and terpolymers, ionomer precursors, thermoplastics, thermoplastic elastomers, polybutadiene rubber, balata, grafted metallocene-catalyzed polymers, non-grafted metallocene-catalyzed polymers, single-site polymers, high-crystalline acid polymers and their ionomers, anionic ionomers, cationic ionomers, or mixtures thereof.

The present invention is also directed to a golf ball, including a core having a diameter, a first Shore D hardness and a compression, and a cover having a second Shore D hardness that is at least 5, preferably 10 points less than the first Shore D hardness. An intermediate layer is disposed between the core and the cover. The intermediate layer and/or the cover includes an ionomer of an alternate copolymer, the alternate copolymer formed from the reaction product of a copolymer of ethylene and maleic anhydride monomer in the presence of a suitable base, the maleic anhydride monomer being present in an amount of up to 78 wt %, preferably about 78%.

There has thus been outlined, rather broadly, the more important features of the invention so that the detailed description thereof that follows may be better understood, and so that the present contribution to the art may be better appreciated. Other features of the present invention will become clearer from the following detailed description of the invention, taken with the accompanying claims, or may be learned by the practice of the invention.

DETAILED DESCRIPTION OF PREFERRED EMBODIMENTS

It has been recognized by the present inventors that it would be advantageous to develop a golf ball having a maleic anhydride alternate copolymer that is partially- or fully-neutralized. As such, a golf ball can comprise a core having a diameter, a first Shore D hardness and a compression; and a cover having a second Shore D hardness that is at least 5, preferably 10 points less than the first Shore D hardness; wherein the core and/or the cover can comprise an ionomer of an alternate copolymer, the alternate copolymer comprising the reaction product of a copolymer of ethylene and maleic anhydride monomer in the presence of a suitable base, the maleic anhydride monomer being present in an amount of up to 78 wt %, preferably about 78 wt %. Additionally, the ionomer of an alternate copolymer is partially-neutralized (10-80%) or highly-neutralized (80-99%) or fully-neutralized (100%). The term "maleic anhydride alternate copolymers" is understood to be interchangeable with the term "maleic anhydride copolymers."

In an alternate embodiment, a golf ball can comprise a core having a diameter, a first Shore D hardness and a compression; and a cover having a second Shore D hardness that is at least 5 points greater than the first Shore D hardness; wherein the core and/or the cover can comprise a copolymer having a maleic anhydride monomer present in the copolymer in an amount of about 78 wt % that is at least partially- or highly-neutralized.

Generally, maleic anhydride polymers used in the golf ball industry have a very low level of maleic anhydride functional groups, i.e., less than 2 wt %, since higher maleic anhydride grafting can cause excessive degradation of the base polymer in the reactive extrusion process. However, the present golf balls achieve at least 2.5 wt % of maleic anhydride by using copolymers of maleic anhydride formed prior to neutralizing such polymers thereby providing a high degree of ionic cross-linking. Higher degree of ionic cross-linking is also evident from the extent of neutralization wherein the neutralization is at least 30 wt %, preferably at least 40 wt %, more preferably at least 50 wt % based on the amount of maleic anhydride present in the polymer. In one embodiment, the maleic anhydride monomer can be present in the copolymer in an amount of about 2.5 wt % to about 78 wt %, preferably 5 to 78 wt %, more preferably 10 to 78 wt %, and most preferably 25 to 78 wt %. In a most preferred embodiment, the maleic anhydride monomer is present in the alternate copolymer in an amount of about 78 wt %.

Such maleic anhydride copolymers can be random, alternate, or block copolymers, including combinations thereof. In one embodiment, the maleic anhydride copolymer can be an alternate copolymer. In another embodiment, the maleic anhydride copolymer can be a random copolymer. In yet another embodiment, the maleic anhydride copolymer can be a block copolymer.

The maleic anhydride, maleic acid, or maleate ester copolymers used herein can be any copolymer containing a maleic anhydride monomer. The maleic anhydride monomers described herein include any monomers containing a maleic anhydride functional group. In one embodiment, the maleic anhydride functional group can be polymerized such that the maleic anhydride functional group forms at least a portion of the polymer backbone. For example, in one embodiment, the maleic anhydride copolymer can be an ethylene maleic anhydride copolymer having the following structure:

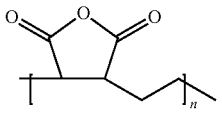

Of course the above structure is not intended to be limiting as the present invention contemplates the use of maleic anhydride as part of the backbone of a copolymer with any monomer(s) described herein. For example, in another embodiment; the maleic anhydride copolymer can be a propylene maleic anhydride copolymer, a butylene maleic anhydride copolymer, a styrene-ethylene-butylene-maleic anhydride block copolymer and a styrene-isoprene-maleic anhydride block copolymer.

Generally, the maleic anhydride alternate copolymers described herein include those where the maleic anhydride has been neutralized in situ such that the post extruded polymer can contain hydrolyzed, neutralized, and/or esterified (mono and/or bi) maleic functional groups. Typically, the maleic anhydride copolymers can have the maleic anhydride functional group hydrolyzed and neutralized in situ during the extrusion process. However, in one embodiment, the present maleic anhydride copolymers can include half esters and neutralized maleic anhydride groups. As such, in one embodiment, the golf balls described herein can have at least 70% of the maleic anhydride copolymer neutralized. In another embodiment, the golf balls can have at least 80%, at least 90%, or even about 100% of the maleic anhydride copolymer neutralized. In yet another embodiment, the golf balls can have less than 70% of the maleic anhydride copolymer neutralized. In still another embodiment, the golf balls can have about 10% to about 60% of the maleic anhydride copolymer neutralized.

Additionally, the golf ball layers can further comprises ionomeric copolymers and terpolymers, ionomer precursors, thermoplastics, thermoplastic elastomers, polybutadiene rubber, balata, grafted metallocene-catalyzed polymers, non-grafted metallocene-catalyzed polymers, single-site polymers, high-crystalline acid polymers and their ionomers, anionic ionomers, cationic ionomers, and mixtures thereof.

In another embodiment, a golf ball layers comprising the said maleic anhydride copolymers and their ionomers and acid derivatives can be blended with several ionomers and non-ionomers including but not limited to:

(1) Vinyl resins, such as those formed by the polymerization of vinyl chloride, or by the copolymerization of vinyl chloride with vinyl acetate, acrylic esters or vinylidene chloride;

(2) Polyolefins, such as polyethylene, polypropylene, polybutylene and copolymers such as ethylene methylacrylate, ethylene ethylacrylate, ethylene vinyl acetate, ethylene methacrylic or ethylene acrylic acid or propylene acrylic acid and copolymers and homopolythers produced using a single-site catalyst or a metallocene catalyst;

(3) Polyurethanes, such as those prepared from polyols and diisocyanates or poly isocyanates, in particular PPDI-based thermoplastic polyurethanes, and those disclosed in U.S. Pat. No. 5,334,673;

(4) Polyureas, such as those disclosed in U.S. Pat. No. 5,484,870;

(5) Polyamides, such as poly(hexamethylene adipamide) and others prepared from diamines and dibasic acids, as well as those from amino acids such as poly(caprolactam), and blends of polyamides with SURLYN®, polyethylene, ethylene copolymers, ethylene-propylene-non-conjugated diene terpolymer, and the like;

(6) Acrylic resins and blends of these resins with poly vinyl chloride, elastomers, and the like;

(7) Thermoplastics, such as urethane acid copolymers; ionomers; olefinic thermoplastic rubbers, such as blends of polyolefins with ethylene-propylene-non-conjugated diene terpolymer; block copolymers of styrene and butadiene, isoprene or ethylene-butylene rubber; or copoly (ether-amide), such as PEBAX®, sold by Arkema of Philadelphia, Pa.;

(8) Polyphenylene oxide resins or blends of polyphenylene oxide with high impact polystyrene as sold under the trademark NORYL® by SABIC Company of Pittsfield, Mass.;

(9) Thermoplastic polyesters, such as polyethylene terephthalate, polybutylene terephthalate, polyethylene terephthalate/glycol modified, poly(trimethylene terepthalate), and elastomers sold under the trademarks HYTREL® by E.I. DuPont de Nemours & Co. of Wilmington, Del., and LOMOD® by General Electric Company of Pittsfield, Mass.;

(10) Blends and alloys, including polycarbonate with acrylonitrile butadiene styrene, polybutylene terephthalate, polyethylene terephthalate, styrene maleic anhydride, polyethylene, elastomers, and the like, and polyvinyl chloride with acrylonitrile butadiene styrene or ethylene vinyl acetate or other elastomers; and

(11) Blends of thermoplastic rubbers with polyethylene, propylene, polyacetal, nylon, polyesters, cellulose esters, and the like.

The maleic anhydride copolymers of the present invention can further be blended with rosin-modified polymers, such as those described in U.S. Pat. No. 7,654,915, which is incorporated herein by reference.

Engineering thermoplastic vulcanizates can also be advantageously used in connection with the maleic anhydride polymers of the present invention. U.S. Pat. No. 7,399,239, which is incorporated herein by reference, describes engineering thermoplastic vulcanizates which are particularly suitable for use in golf balls, some of which are commercially available as DuPont ETPV® resins.

Similarly, bi-modal and soft, resilient polymers can also be used with the maleic anhydride polymers of the present invention. Bi-modal ionomers for use in the present invention are described in U.S. Pat. No. 7,037,967 which is incorporated herein by reference.

Various olefin/polar copolymers as disclosed in U.S. Pat. No. 7,479,531 can also be suitable for use in blends with the maleic anhydride polymers of the present invention.

In the golf balls of the present invention, the golf ball can further comprise acid polymers, including an ionic plasticizer as described herein. The acid polymers can generally be homopolymers or copolymers of α,β-ethylenically unsaturated mono- or dicarboxylic acids, including combinations thereof. Non-limiting examples of α,β-ethylenically unsaturated mono- or dicarboxylic acids are (meth)acrylic acid, ethacrylic acid, maleic acid, crotonic acid, fumaric acid, itaconic acid. In one particular embodiment, (Meth)acrylic acid may be selected for use.

U.S. Patent Application Publication Nos. 2003/0114565, and 2003/0050373, which are incorporated by reference herein in their entirety, discuss soft, high resilient ionomers, which are can be obtained by neutralizing the acid copolymer(s) of at least one E/X/Y copolymer, where E is ethylene, X is the α,β-ethylenically unsaturated carboxylic acid, and Y is a softening co-monomer. X is specifically present in 2-30 (in one embodiment 4-20, or in another embodiment 5-15) wt. % of the polymer, and Y is specifically present in 17-40 (in some aspects 20-40, and in further aspects 24-35) wt. % of the polymer. The melt index ("MI") of the base resin is typically at least 20 g/10 min, or at least 40 g/10 min, in some embodiments, at least 75 g/10 min and in other embodiments at least 150 g/10 min. Particular soft, resilient ionomers included in this invention can be partially neutralized ethylene/(meth)acrylic acid/butyl(meth)acrylate copolymers having an MI and level of neutralization that results in a melt processable polymer that has useful physical properties. When used, a softening monomer can be an alkyl (meth)acrylate, wherein the alkyl groups have from 1 to 8 carbon atoms. Specific non-limiting examples of E/X/Y-type copolymers are those where X is (meth)acrylic acid and/or Y is selected from (meth)acrylate, n-butyl(meth)acrylate, isobutyl(meth)acrylate, methyl(meth)acrylate, and ethyl (meth)acrylate. Particularly suitable E/X/Y-type copolymers are ethylene/(meth)acrylic acid/n-butyl acrylate, ethylene/(meth)acrylic acid/methyl acrylate, and ethylene/(meth) acrylic acid/ethyl acrylate. In another aspect, the acid polymer can be ethylene-acrylic or (meth)acrylic copolymers or terpolymers (e.g. an alkyl ester such as butyl acrylate).

The copolymers can be at least partially neutralized. In one embodiment, the acid copolymers can be partially neutralized by at least 40%, at least 55%, or even at least 65%. Additionally, the acid copolymers can be highly neutralized by at least 70%, at least 80%, at least 95%, or even about 100%. Such acid copolymers can be neutralized to the same degree as discussed herein with respect to the maleic anhydride copolymers. In one embodiment, about 90% of the acid moiety of the acid copolymer is neutralized by one or more alkali metal, transition metal, or alkaline earth metal cations. Additionally, the maleic anhydride copolymers can be neutralized to the same degree as the acid copolymers.

Examples of suitable ionic polymers include without limitation SURLYN® ionomers, from DuPont; ACLYN® ionomers, from Honeywell International Inc.; IOTEK® ionomers, from Exxon Mobil Chemical Company; CLARIX® ionomers, commercially-available from A. Schulman, Inc.; AMPLIFY® IO ionomers from Dow Chemical; and the acid copolymers described in U.S. Pat. No. 6,953,820, the entire disclosure of which is hereby incorporated herein by reference.

Suitable cation sources include without limitation, metal cations and salts thereof, organic amine compounds, ammonium, and combinations thereof. In some aspects, cation sources can be metal cations and salts thereof, wherein the metal is lithium, sodium, potassium, magnesium, calcium, barium, lead, tin, zinc, aluminum, manganese, nickel, chromium, copper, or a combination thereof. Other cation sources can also be suitable. The amount of cation used in the composition is readily determined based on the desired level of neutralization.

The acid polymers can be direct copolymers where the polymer is polymerized by adding all monomers simultaneously, as described in, for example, U.S. Pat. No. 4,351,931, the entire disclosure of which is hereby incorporated herein by reference. Ionomers can also be made from direct copolymers, as described in, for example, U.S. Pat. No. 3,264,272, the entire disclosure of which is hereby incorporated herein by reference. Alternatively, the acid polymers of the present invention can be graft copolymers, wherein a monomer is grafted onto an existing polymer, as described in, for example, U.S. Patent Application Publication No. 2002/0013413, the entire disclosure of which is hereby incorporated herein by reference. Other polymer types can also be prepared, as are known in the art, e.g., block copolymers, random copolymers, etc.

In some embodiments, the compositions described herein may contain fatty acids and salts thereof that can improve processability, but may be processable without them. If used, organic acids can be blended or melt-blended with other ionomers or polymers as an unmodified or modified organic acid or salt thereof. Typically, the organic acids or salts thereof can be aliphatic, monofunctional organic acids having from 6 to 36 carbon atoms per molecule. These organic acids can be partially neutralized or fully neutralized as described herein. The organic acids can also be non-volatile and non-migratory. Non-limiting examples of suitable fatty acid as the organic acid can include caproic acid, caprylic acid, capric acid, lauric acid, palmitic acid, stearic acid, behenic acid, erucic acid, oleic acid, linoleic acid, and salts thereof. The salts of organic acids of the present invention include the salts of barium, lithium, sodium, zinc, bismuth, chromium, cobalt, copper, potassium, strontium, titanium, tungsten, magnesium, cesium, iron, nickel, silver, aluminum, tin, or calcium, salts of fatty acids, particularly stearic, behenic, erucic, oleic, linoleic or dimerized derivatives thereof, and mixtures thereof. In one embodiment of the present invention, the composition can be substantially free of fatty acids and their salts. However, fatty acids and salts thereof may be used in the composition without departing from the spirit of the invention. As such, in another embodiment, the composition can comprise a fatty acid, or salt thereof, in an amount of about 10 wt % to about 75 wt %. In yet another embodiment, the organic acid can be selected from the group consisting of aliphatic organic acids, aromatic organic acids, saturated mono-functional organic acids, unsaturated mono-functional organic acids, and multi-unsaturated mono-functional organic acids.

Golf balls of the present invention can include one-piece, two-piece, multi-layer, and wound golf balls having a variety of core structures, intermediate layers, covers, and coatings. Golf ball cores may comprise a single, unitary layer, comprising the entire core from the center of the core to its outer periphery. Alternatively, the cores may comprise or consist of a center surrounded by at least one outer core layer. The center, innermost portion of such multi-layer cores is most often solid, but may be hollow or liquid-, gel-, or gas-filled. The outer core layer may be solid, or it may be a wound layer formed of a tensioned elastomeric or non-elastomeric material. Golf ball covers may also include one or more layers, such as a double cover having an inner and outer cover layer. Optionally, additional intermediate layers may be disposed between the core and cover. In one embodiment of the present invention, golf ball includes a core and a cover layer. In another embodiment, the golf ball includes a core, an intermediate layer, and a cover layer. The golf balls can include those materials and constructions as described in U.S. Application Publication No. 2007/0232414, U.S. Pat. No. 6,939,907, each of which is incorporated herein by reference in their entireties.

In another embodiment for a three piece golf ball, the core surface hardness of at least 83 JIS C or 52 Shore D, a casing surface hardness measured on the ball at least 90 JIS C or 91 Shore C or 62 Shore D, a 10 days aged button hardness for the casing layer of at least 90 JIS C or 60 Shore D, a ball cover hardness of at least 81 JIS C or 82 Shore C or 59 Shore D and a 10 days aged button hardness for the cover layer of at least 72 JIS C or 72 Shore C or 47 Shore D.

In another embodiment for a four piece golf ball, the inner core surface hardness of at least 76 JIS C or 43 Shore D, an outer core surface hardness measured on the ball at least 89 JIS C or 60 Shore D, a casing surface hardness measured on the ball at least 93 JIS C or 92 Shore C or 61 Shore D, a 10 days aged button hardness for the casing layer of at least 90 JIS C or 60 Shore D, a ball cover hardness of at least 81 JIS C or 82 Shore C or 59 Shore D and a 10 days aged button hardness for the cover layer of at least 72 JIS C or 72 Shore C or 47 Shore D.

In another embodiment for a three cover golf ball, the inner core surface hardness of at least 83 Shore C or 45 Shore D, an innermost cover layer has a surface hardness measured on the ball at least 90 Shore C or 60 Shore D, an intermediate layer has a surface hardness measured on the ball at least 93 Shore C or 62 Shore D, a 10 days aged button hardness for the casing layer of at least 65 Shore D, a ball cover hardness of at least 80 Shore C or 59 Shore D and a 10 days aged button hardness for the cover layer of at least 72 JIS C or 72 Shore C or 47 Shore D.

In another embodiment for a dual core and a single cover golf ball, the core surface hardness of at least 74 JIS C or 40 Shore D, an outer core surface hardness measured on the ball at least 85 JIS C or 55 Shore D, a ball cover hardness of at least 55 Shore D and a 10 days aged button hardness for the cover layer of at least 56 Shore D. In another embodiment for a single core and a single cover golf ball, the core surface hardness of at least 78 JIS C or 44 Shore D, a ball cover hardness of at least 63 Shore D and a 10 days aged button hardness for the cover layer of at least 64 Shore D. The materials of the present invention may also be used as a cover or intermediate layer(s) for 5- and 6-piece golf balls.

As discussed herein, the maleic anhydride alternate copolymers (and their ionomer derivatives) can be used in any layer of the golf ball as required in order to aid in providing such ball certain desired performance characteristics and benefits. As such, in one embodiment, the maleic anhydride copolymer can be included in the core. In another embodiment, the maleic anhydride copolymer can be included in the cover. In still another embodiment, the maleic anhydride copolymer can be included in an intermediate layer.

The cover layer, or any layer of a multiple layer cover, can be formed of suitable polymers such as the copolymers described herein, polyurethanes, or polyureas. The outer cover layer and/or the inner cover layer can comprise a light stable polyurethane, polyurea, and/or the copolymers described herein.

Golf balls of the present invention generally also have a coefficient of restitution ("COR") of at least 0.790, such as at least 0.800, in some cases at least 0.805, and even other cases at least 0.810. COR is defined as the ratio of the rebound velocity to the inbound velocity when balls are fired into a rigid plate. In determining COR, the inbound velocity is understood to be 125 ft/s.

Additionally, the copolymers described herein can have a melt flow index of at least 0.5 g/10 min at 190° C. (ASTM D-1238). More particularly, the melt flow index of the copolymers described herein can be from 0.5 g/10 min to 10.0 g/10 min, such as from 1.0 g/10 min to 4.0 g/10 min, and in some cases from 2.0 g/10 min to 3.0 g/10 min. In an alternate embodiment, the neutralized maleic anhydride polymers and their blends of the present invention have no flow at 190° C. (ASTM D-1238) to provide melt flow resistance when other materials, such as butadiene rubbers or high-temperature polymers, are molded over such a layer.

Various properties of the golf ball can dramatically affect performance. These properties can be a result of the particular materials and golf ball design chosen. Accordingly, in one embodiment, the core can have a diameter of at least about 1.53 inches. In another embodiment, the core can have a diameter of at least 1.58 inches. In yet another embodiment, the core has a diameter of at most 1.53 inches. In still another embodiment, the core has a diameter of at most 1.58 inches. Additionally, in some embodiments, the golf balls, and the individual components described herein, can have an Atti compression of at least 80 or at most 80. Additionally, the compression can be less than or equal to about 70, or less than or equal to about 90. In one embodiment, the golf ball can comprise a second polymer in an amount sufficient to reduce the compression to no more than 70.

As discussed herein, the alternate copolymers and ionomers thereof can be used as a core or as an outer core layer or as a casing/inner cover and outer cover layer. In one embodiment, the copolymers can be used as a casing layer or a core layer. The hardness of these compositions may be from about 30 to 75 Shore D, about 40 to 70 D, or even from about 50 to 68 D. While the hardness of the cover has been described as being at least 10 points less than the hardness of the core, in another embodiment, the cover or outer layer can have a hardness that is at least 5 points less than a hardness of the core or an intermediate layer. Additionally, flexural modulus of these compositions can be from 30,000 to 90,000 psi, an in one aspect 40,000 to 70,000 psi.

In an alternate embodiment, the hardness of the above core or the intermediate or the cover compositions may be from about 30 to 75 Shore D, about 40 to 70 D, or even from about 50 to 68 D. While the hardness of the cover has been described as being at least 10 points greater than the hardness of the core, in another embodiment, the cover or outer layer can have a hardness that is at least 5 points greater than a hardness of the core or an intermediate layer. Additionally, flexural modulus of these compositions can be from 30,000 to 90,000 psi, an in one aspect 40,000 to 70,000 psi.

In one embodiment, a golf ball can have a core that includes a thermoset rubber having a diameter of about 0.5 to 1.62 inches; a cover disposed over the core having a Shore D hardness of about 55 or less; and an intermediate layer including a maleic anhydride polymer neutralized in the presence of a suitable neutralizing agent along with an organic acid or a salt thereof, the an organic acid or a salt thereof being present in an amount sufficient to neutralize the polymer by no greater than 70%. In another embodiment, a maleic anhydride polymer neutralized in the presence of a suitable neutralizing agent along with the polymeric non-ionic melt flow modifiers.

In another embodiment, the cover can comprise a polyurethane or polyurea. In one embodiment, the intermediate layer can have a Shore D hardness of at least about 62. In another embodiment, the cover can have a thickness of about 0.04 or less. In still another embodiment, the core can have a compression of about 70 or less and a diameter of at least 1.4 inches.

The present invention is also directed to a golf ball that can comprise a center including a liquid, the center having a diameter of about 1.0 inches or less; an intermediate layer including a maleic anhydride polymer is neutralized with a suitable neutralizing agent in the presence of an organic acid or a salt thereof, the an organic acid or a salt thereof being present in an amount greater than about 10 weight percent such that the polymer is saturated, the intermediate layer being disposed about the center to form a core; and a cover disposed over the core. Other materials, such as highly-neutralized polymers (i.e., DuPont HPF® 1000 and HPF® 2000), may be used to form the center or outer cores layers (dual core) or a single core.

The polyurethane cover of the present invention can include a polyisocyanate, a polyol, and at least one curing agent as disclosed in the U.S. Pat. No. 6,756,436. The polyisocyanate can include 4,4'-diphenylmethane diisocyanate; polymeric 4,4'-diphenylmethane diisocyanate; carbodiimide-modified liquid 4,4'-diphenylmethane diisocyanate; 4,4'-dicyclohexylmethane diisocyanate; p-phenylene diisocyanate; m-phenylene diisocyanate; toluene diisocyanate; 3,3'-dimethyl-4,4'-biphenylene diisocyanate; isophoronediisocyanate; hexamethylene diisocyanate; naphthalene diisocyanate; xylene diisocyanate; p-tetramethylxylene diisocyanate; m-tetramethylxylene diisocyanate; ethylene diisocyanate; propylene-1,2-diisocyanate; tetramethylene-1,4-diisocyanate; cyclohexyl diisocyanate; 1,6-hexamethylene-diisocyanate; dodecane-1,12-diisocyanate; cyclobutane-1,3-diisocyanate; cyclohexane-1,3-diisocyanate; cyclohexane-1,4-diisocyanate; 1-isocyanato-3,3,5-trimethyl-5-isocyanatomethylcyclohexane; methyl cyclohexylene diisocyanate; triisocyanate of hexamethylene-diisocyanate; triisocyanate of 2,4,4-trimethyl-1,6-hexane diisocyanate; tetracene diisocyanate; napthalene diisocyanate; anthracene diisocyanate; isocyanurate of toluene diisocyanate; uretdione of hexamethylene diisocyanate; di-isocyanates, tri-isocyanates, or tetra-isocyanates. In one aspect of the present invention, the polyisocyanate includes less than about 0.1% free monomer groups or the polyisocyanate comprises less than about 7.5% unreacted NCO groups.

The polyol can include polyether polyols, fully-hydrogenated hydroxy-terminated polybutadiene; partially-hydrogenated hydroxy-terminated polybutadiene; polyester polyols; polycaprolactone polyols; or polycarbonate polyols and the curing agent includes diols, triols, tetraols, hydroxy-terminated curatives, or polyamines.

The polyamine can include 3,5-dimethylthio-2,4-toluenediamine and isomers thereof; 3,5-diethyltoluene-2,4-diamine and isomers thereof; 3,5-diethyltoluene-2,6-diamine; 4,4'-bis-(sec-butylamino)-diphenylmethane; 1,4-bis-(sec-butylamino)-benzene, 4,4'-methylene-bis-(2-chloroaniline); 4,4'-methylene-bis-(3-chloro-2,6-diethylaniline); polytetramethyleneoxide-di-p-aminobenzoate; N,N'-dialkyl-diamino diphenyl methane; p,p'-methylene dianiline; m-phenylenediamine; 4,4'-methylene-bis-(2-chloroaniline); 4,4'-methylene-bis-(2,6-diethylaniline); 4,4'-methylene-bis-(2,3-dichloroaniline); 4,4'-diamino-3,3'-diethyl-5,5'-dimethyl diphenylmethane; 2,2',3,3'-tetrachloro diamino diphenylmethane; or trimethylene glycol di-p-aminobenzoate.

The polyurea cover composition as disclosed in the U.S. Pat. No. 6,958,679 can also be used in the present invention. The polyurea is formed from a prepolymer includes a polyisocyanate and a polyamine, and at least one polyamine curing agent. At least one of the polyamine in the prepolymer or the polyamine curing agent can include polyether amines; methyldiethanolamine; polyoxyalkylenediamines; polytetramethylene ether diamines; polyoxypropylenetriamine; polyoxypropylene diamines; poly(ethylene oxide capped oxypropylene) ether diamines; propylene oxide-based triamines; triethyleneglycoldiamines; trimethylolpropane-based triamines; glycerin-based triamines; ethylene diamine; hexamethylene diamine; 1-methyl-2,6-cyclohexyl diamine; tetrahydroxypropylene ethylene diamine; 2,2,4- and 2,4,4-trimethyl-1,6-hexanediamine; 4,4'-bis-(sec-butylamino)-dicyclohexylmethane; 1,4-bis-(sec-butylamino)-cyclohexane; 1,2-bis-(sec-butylamino)-cyclohexane; derivatives of 4,4'-bis-(sec-butylamino)-dicyclohexylmethane; 4,4'-dicyclohexylmethane diamine; 1,4-cyclohexane-bis-(methylamine); 1,3-cyclohexane-bis-(methylamine); diethylene glycol di-(aminopropyl)ether; 2-methylpentamethylene-diamine; diaminocyclohexane; diethylene triamine; triethylene tetramine; tetraethylene pentamine; propylene diamine; 1,3-diaminopropane; dimethylamino propylamine; diethylamino propylamine; dipropylene triamine; imido-bis-propylamine; monoethanolamine, diethanolamine; triethanolamine; monoisopropanolamine, diisopropanolamine; isophoronediamine; 4,4'-methylenebis-(2-chloroaniline); 3,5;dimethylthio-2,4-toluenediamine; 3,5-dimethylthio-2,6-toluenediamine; 3,5-diethylthio-2,4-toluenediamine; 3,5;diethylthio-2,6-toluenediamine; 4,4'-bis-(sec-butylamino)-diphenylmethane and derivatives thereof; 1,4-bis-(sec-butylamino)-benzene; 1,2-bis-(sec-butylamino)-benzene; N,N'-dialkylamino-diphenylmethane; N,N,N',N'-tetrakis (2-hydroxypropyl) ethylene diamine; trimethyleneglycol-di-p-aminobenzoate; polytetramethyleneoxide-di-p-aminobenzoate; 4,4'-methylenebis-(3-chloro-2,6-diethyleneaniline); 4,4'-methylenebis-(2,6-diethylaniline); m-phenylenediamine; or p-phenylenediamine. In one embodiment, the polyamine curing agent includes a hindered secondary diamine.

At least one of the polyamine in the prepolymer or the polyamine curing agent has a molecular Weight of between about 100 and about 5000. In one embodiment, the blend includes one or more saturated, unsaturated, aromatic, or cyclic groups.

The golf balls of the present invention can also include one or more other additives as desired in order to produce a golf ball with specific characteristics or properties. Suitable additives include, but are not limited to, chemical blowing and foaming agents, optical brighteners, coloring agents, fluorescent agents, whitening agents, UV absorbers, light stabilizers, defoaming agents, processing aids, mica, talc, nano-fillers, antioxidants, stabilizers, softening agents, fragrance components, plasticizers, impact modifiers, $TiO_2$, acid copolymer wax, surfactants, and fillers, such as zinc oxide, tin oxide, barium sulfate, zinc sulfate, calcium oxide, calcium carbonate, zinc carbonate, barium carbonate, clay, tungsten, tungsten carbide, silica, lead silicate, regrind (recycled material), and mixtures thereof. Suitable additives are more fully described in, for example, U.S. Pat. No. 7,041,721, the entire disclosure of which is hereby incorporated herein by reference. Other optional additives can include fibers, flakes, particulates, microspheres, pre-expanded beads of glass, ceramic, metal or polymer, and the like which may be optionally foamed. Depending on the additive, such additives can be present in an amount of from 0.01 wt % to 60 wt %, based on the total weight of the composition.

The foregoing detailed description describes the invention with reference to specific exemplary embodiments. However, it will be appreciated that various modifications and changes can be made without departing from the scope of the present invention as set forth in the appended claims. The detailed description is to be regarded as merely illustrative, rather than as restrictive, and all such modifications or changes, if any, are intended to fall within the scope of the present invention as described and set forth herein.

EXAMPLES

The following examples illustrate embodiments of the invention that are presently known. Thus, these examples should not be considered as limitations of the present invention, but are merely in place to teach how to make compositions of the present invention. As such, a representative number of compositions and their method of manufacture are disclosed herein.

Example 1

Preparation of a Maleic Anhydride Copolymer Composition

An alternate copolymers of ethylene-maleic anhydride, such as ZEMAC® E60 or E300, or their acid or mono-ester derivatives, is fed into the twin-screw extruder in the presence of a suitable amount of neutralizing agents such as Li, Na, or Mg hydroxides or ZnO in order to achieve at least partial-neutralization level. Optional melt flow modifiers, such as an organic fatty acid (or non-fatty acid or salt thereof) and a salt thereof, is incorporated in order to achieve a desirable melt flow. The neutralization is no greater than 70 wt %, and in one aspect 30 to 60 wt %, and a fatty acid or their salts level is from 5 to 50 wt %, and in one aspect 10 to 40 wt %. The maleic anhydride level in the alternate copolymer is about 78 wt %.

TABLE I

Properties of Maleic Anhydride copolymers ZEMAC ® E60 and ZEMAC ® E400

| | ZEMAC ® E60 Alternate copolymer of ethylene-maleic anhydride | ZEMAC ® E400 Alternate copolymer of ethylene-maleic anhydride |
|---|---|---|
| Weight Average Molecular Weight | 60,000 | 400,000 |
| Specific viscosity (25° C.) | 0.12-0.22 | 0.75-1.05 |
| Residual maleic anhydride | No more than 1.5 wt % | No more than 0.2 wt % |
| Glass transition temperature (° C.) | 155-159 | Not available |
| Density (g/ml) | 1.4 | Not available |
| Polydispersity Index | 2.0 | Not available |

Prophetic Examples

Preparation of Golf Ball Having Maleic Anhydride Copolymers

The following compositions were used to produce the following prophetic core or the intermediate of the cover examples based on the blends of an alternate copolymer of ethylene-maleic anhydride and a partially neutralized ionomer neutralized which were further neutralized with sodium hydroxide with and without a flow modifier.

TABLE II

Prophetic Examples: Golf ball core, intermediate layer, or cover layer compositions based on blends of an alternate copolymer of ethylene-maleic anhydride and a partially-neutralized ionomer, where the blends are further neutralized with sodium hydroxide.

| | Ex. 1 (parts) | Ex. 2 parts) | Ex. 3 parts) | Ex. 4 (parts) | Ex. 5 (parts) | Ex. 6 (parts) | Ex. 7 (parts) | Ex. 8 (parts) | Ex. 9 (parts) |
|---|---|---|---|---|---|---|---|---|---|
| [1]SURLYN ® 9910 | 97.5 | 95 | 92.5 | 85 | 70 | 55 | 50 | 25 | 0 |
| [2]ZEMAC ® E60 | 2.5 | 5.0 | 7.5 | 15 | 30 | 45 | 50 | 75 | 100 |
| NaOH | 6.99 | 6.99 | 6.99 | 6.99 | 6.99 | 6.99 | 6.99 | 6.99 | 6.99 |
| Zinc Stearate | — | — | — | — | — | — | — | — | — |

[1]SURLYN ® 9910 is a Zinc ionomer based on a copolymer of ethylene with 15% methacrylic acid from DuPont

[2]ZEMAC ® E60 is an alternate copolymer of ethylene-maleic anhydride from Vertellus Sepcialities Inc.

TABLE III

Prophetic Examples: Golf ball core, intermediate layer, or cover layer compositions based on blends of an alternate copolymer of ethylene-maleic anhydride and a partially-neutralized ionomer, where the blend are further neutralized with sodium hydroxide in the presence of a zinc stearate flow modifier.

| | Ex. 1 (parts) | Ex. 2 parts) | Ex. 3 parts) | Ex. 4 (parts) | Ex. 5 (parts) | Ex. 6 (parts) | Ex. 7 (parts) | Ex. 8 (parts) | Ex. 9 (parts) |
|---|---|---|---|---|---|---|---|---|---|
| SURLYN ® 9910 | 97.5 | 95 | 92.5 | 85 | 70 | 55 | 50 | 25 | 0 |
| ZEMAC ® E60 | 2.5 | 5.0 | 7.5 | 15 | 30 | 45 | 50 | 75 | 100 |
| NaOH | 6.99 | 6.99 | 6.99 | 6.99 | 6.99 | 6.99 | 6.99 | 6.99 | 6.99 |
| Zinc Stearate | 25 | 25 | 25 | 25 | 25 | 25 | 25 | 25 | 25 |

TABLE IV

Prophetic Examples: Golf ball core, intermediate layer, or cover layer compositions based on blends of an alternate copolymer of ethylene-maleic anhydride and a partially-neutralized ionomer, where the blends are further neutralized with sodium hydroxide.

| | Ex. 1 (parts) | Ex. 2 parts) | Ex. 3 parts) | Ex. 4 (parts) | Ex. 5 (parts) | Ex. 6 (parts) | Ex. 7 (parts) | Ex. 8 (parts) | Ex. 9 (parts) |
|---|---|---|---|---|---|---|---|---|---|
| SURLYN ® 9910 | 97.5 | 95 | 92.5 | 85 | 70 | 55 | 50 | 25 | 0 |
| [3]ZEMAC ® E400 | 2.5 | 5.0 | 7.5 | 15 | 30 | 45 | 50 | 75 | 100 |
| NaOH | 6.99 | 6.99 | 6.99 | 6.99 | 6.99 | 6.99 | 6.99 | 6.99 | 6.99 |
| Zinc Stearate | — | — | — | — | — | — | — | — | — |

[3]ZEMAC ® E400 is an alternate copolymer of ethylene-maleic anhydride from Vertellus Specialties Inc.

TABLE V

Prophetic Examples: Golf ball core, intermediate layer, or cover layer compositions based on blends of an alternate copolymer of ethylene-maleic anhydride and a partially-neutralized ionomer, where the blends are further neutralized neutralized with sodium hydroxide in the presence of a zinc stearate flow modifier.

| | Ex. 1 (parts) | Ex. 2 parts) | Ex. 3 parts) | Ex. 4 (parts) | Ex. 5 (parts) | Ex. 6 (parts) | Ex. 7 (parts) | Ex. 8 (parts) | Ex. 9 (parts) |
|---|---|---|---|---|---|---|---|---|---|
| SURLYN ® 9910 | 97.5 | 95 | 92.5 | 85 | 70 | 55 | 50 | 25 | 0 |
| ZEMAC ® E400 | 2.5 | 5.0 | 7.5 | 15 | 30 | 45 | 50 | 75 | 100 |
| NaOH | 6.99 | 6.99 | 6.99 | 6.99 | 6.99 | 6.99 | 6.99 | 6.99 | 6.99 |
| Zinc Stearate | 25 | 25 | 25 | 25 | 25 | 25 | 25 | 25 | 25 |

Other than in the operating examples, or unless otherwise expressly specified, all of the numerical ranges, amounts, values and percentages such as those for amounts of materials and others in the specification may be read as if prefaced by the word "about" even though the term "about" may not expressly appear with the value, amount or range. Accordingly, unless indicated to the contrary, the numerical parameters set forth in the specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contain certain errors necessarily resulting from the standard deviation found in their respective testing measurements. Furthermore, when numerical ranges of varying scope are set forth herein, it is contemplated that any combination of these values inclusive of the recited values may be used.

While it is apparent that the illustrative embodiments of the invention disclosed herein fulfill the objective stated above, it is appreciated that numerous modifications and other embodiments may be devised by those skilled in the art. Therefore, it will be understood that the appended claims are intended to cover all such modifications and embodiments, which would come within the spirit and scope of the present invention.

What is claimed is:

1. A golf ball, comprising:

a core having a diameter, a first Shore D hardness and a compression; and a cover having a second Shore D hardness that is at least 5 points greater than the first Shore D hardness;

wherein the cover comprises an ionomer of an alternate copolymer, the alternate copolymer comprising the reaction product of a copolymer of ethylene and maleic anhydride monomer in the presence of a suitable base, the maleic anhydride monomer being present in an amount of about 78 wt %.

2. The golf ball of claim 1, wherein the ionomer of an alternate copolymer further comprises a flow modifier.

3. The golf ball of claim 2, wherein flow modifier comprises a fatty-acid salt or non-fatty-acid salt.

4. The golf ball of claim 3, wherein the fatty acid salt, or non-fatty acid salt, is present in an amount of about 10 wt % to about 50 wt %.

5. The golf ball of claim 1, wherein the golf ball further comprises an intermediate layer having a melt flow of about 0 g/10 min at 190° C. to about 5.0 g/10 min at 190° C.

6. The golf ball of claim 5, wherein the intermediate layer melt flow is about 0 g/10 min at 190° C.

7. The golf ball of claim 5, wherein the intermediate layer comprises a highly-neutralized polymer, an ionomer of an alternate copolymer, or a mixture thereof.

8. The golf ball of claim 1, wherein the core comprises the ionomer of an alternate copolymer.

9. The golf ball of claim 1, wherein the ionomer of an alternate copolymer is blended with a conventional acid copolymer or the ionomeric derivatives thereof.

10. The golf ball of claim 1, wherein the cover comprises ionomeric copolymers and terpolymers, ionomer precursors, thermoplastics, thermoplastic elastomers, polybutadiene rubber, balata, grafted metallocene-catalyzed polymers, non-grafted metallocene-catalyzed polymers, single-site polymers, high-crystalline acid polymers and their ionomers, anionic ionomers, cationic ionomers, or mixtures thereof.

11. A golf ball, comprising:

a core having a diameter, a first Shore D hardness and a compression;

a cover having a second Shore D hardness that is at least 5 points less than the first Shore D hardness; and an intermediate layer disposed between the core and the cover;

wherein the intermediate layer and/or the cover comprises an ionomer of an alternate copolymer, the alternate copolymer comprising the reaction product of a copolymer of ethylene and maleic anhydride monomer in the presence of a suitable base, the maleic anhydride monomer being present in an amount of about 78 wt %.

* * * * *